US007625191B2

(12) United States Patent
Goepfert

(10) Patent No.: US 7,625,191 B2
(45) Date of Patent: Dec. 1, 2009

(54) ROTARY DISPLACEMENT MACHINES HAVING ROTORS OF ASYMMETRICAL PROFILE

(75) Inventor: Olivier Goepfert, Porrentruy (CH)

(73) Assignee: Ateliers Busch SA, Chevenez (CH)

( * ) Notice: Subject to any disclaimer, the term of this patent is extended or adjusted under 35 U.S.C. 154(b) by 0 days.

(21) Appl. No.: 11/883,307

(22) PCT Filed: Feb. 16, 2005

(86) PCT No.: PCT/EP2005/050692

§ 371 (c)(1),
(2), (4) Date: Jul. 30, 2007

(87) PCT Pub. No.: WO2006/087038

PCT Pub. Date: Aug. 24, 2006

(65) Prior Publication Data

US 2008/0240967 A1 Oct. 2, 2008

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/150; 418/190; 418/201.3

(58) Field of Classification Search ..... 418/150, 418/189, 190, 206.1, 206.5, 201.1, 201.3
See application file for complete search history.

(56) References Cited

U.S. PATENT DOCUMENTS

| | | | | |
|---|---|---|---|---|
| 2,705,922 | A * | 4/1955 | Rathman | 418/201.1 |
| 2,931,308 | A * | 4/1960 | Luthi | 418/150 |
| 2,994,562 | A * | 8/1961 | Zalis | 418/201.1 |
| 3,640,649 | A | 2/1972 | Persson | |
| 4,445,831 | A | 5/1984 | Ingalls | |
| 5,667,370 | A * | 9/1997 | Im | 418/201.1 |
| 6,447,276 | B1 * | 9/2002 | Becher | 418/201.3 |
| 6,964,560 | B2 * | 11/2005 | Yoshimura | 418/201.1 |
| 2003/0152475 | A1 | 8/2003 | Becher | |

FOREIGN PATENT DOCUMENTS

| | | |
|---|---|---|
| DE | 686 298 | 4/1943 |
| GB | 112 104 | 7/1917 |
| GB | 1 342 287 | 1/1974 |
| WO | WO 02/08609 A1 | 1/2002 |

* cited by examiner

*Primary Examiner*—Theresa Trieu
(74) *Attorney, Agent, or Firm*—Oliff & Berridge PLC

(57) ABSTRACT

Rotary displacement machine having a housing and at least two twinned rotors of asymmetrical profile, the twinned rotors each made of a core on which projects a helicoidal thread which extends above the core like a tooth. The helicoidal thread having a first predetermined dimension in a direction radial to the longitudinal axis of the twinned rotors and above the surface of a rotor. The machine having a first flank with a position and length of arc predetermined such that the shape of the first flank and the shape of the second flank each connect to one of the opposite ends of a connecting segment which constitutes a helicoidal surface. The connecting segment having a second predetermined dimension in a direction radial to the longitudinal axis of the twinned rotors such that the ratio of the second dimension over the first dimension ranges between 0.005 and 0.1.

6 Claims, 8 Drawing Sheets

ROTARY DISPLACEMENT MACHINES HAVING ROTORS OF ASYMMETRICAL PROFILE

CROSS-REFERENCE TO RELATED APPLICATION

This application is a national phase application under 35 U.S.C. § 371 of PCT International Application No. PCT/EPO5/50692, which has an international filing date of Feb. 16, 2005, and which is designated the United States of America.

BACKGROUND

The invention relates to an improvement in rotary displacement machines.

SUMMARY

The invention concerns rotary displacement machines intended to receive compressible fluids and able to be used as pumping machines, even as engines.

The invention concerns more particularly, but not in a limiting way, the machines which comprise a housing and at least two twinned rotors, i.e. a first rotor and a second rotor, said rotors being mounted rotating in said housing and driving in directions which are opposed, one with respect to the other.

The rotors are conventionally composed of pieces of screw shape, i.e. pieces including a core bearing one or more threads of which the pitch can be constant or variable along the longitudinal dimension of said rotor.

In the housing, the screws form a series of "chambers without connections" for which the leaks due to operational play as well as to the architecture and the geometry of the machine influence the volumetric efficiency, the energy efficiency as well as the final pressure obtained.

Owing to the fact that the rotors mesh in the manner of toothed wheels, one looks upon the thread or threads as each constituting a tooth situated projecting on the central core.

The rotors can be represented in section according to a transverse plane approximately orthogonal to the longitudinal axes of their core.

On the sections, one can observe the shape of each tooth, and, to be precise, note that the outer contour of this tooth is defined by two opposite flanks, i.e. a first flank and a second flank which each extend between the core of the rotor being considered, and a portion of the tooth which is situated at a predetermined distance from the core and at the level of which said first flank and second flank are connected.

One distinguishes in general between three categories of rotors according to the cross section of the tooth or teeth of these rotors, and, to be precise, rotors with cross sections referred to as mating, rotors with profiles referred to as symmetrical, and rotors with profiles referred to as asymmetrical.

As concerns the expression "rotors with mating profiles", it characterizes the use of rotors the profiles of the teeth of which are different and, particularly, on the one hand, a first rotor equipped with at least one tooth having a first convex flank and a second convex flank, and, on the other hand, a second rotor equipped with at least one tooth which can have a first concave flank and a second concave flank, or a first flank on which one can distinguish two consecutive portions. The two consecutive portions are a first concave portion and a second convex portion. The second rotor may also be equipped with a second flank on which one can also distinguish two consecutive portions, which are a third convex portion and a fourth concave portion.

The manufacture by machining of this type of rotors with mating profiles is relatively easy, and the essential difficulty resides in the calculation of the profiles.

As concerns the expression "rotors with sections called symmetrical", it characterizes the use of rotors, on the one hand, of which the first flank and the second flank of each tooth are symmetrical with respect to a radial axis passing through the centre of the tooth, and, on the other hand, of which the geometry of the section is symmetrical and similar for the two rotors.

The calculation of the profiles and the manufacture by machining of this type or rotors with symmetrical profiles are easy, but the tightness derived from the co-operation of the rotors in the zones of the tooth crests (upper zones of the teeth) of the rotors is imperfect which can negatively affect the volumetric efficiency of the machines which contain them.

Concerning the expression "rotors having asymmetrical profiles," it characterizes the use of a first rotor and of a second rotor which have similar profiles and of which at least one tooth has a first convex flank and a second concave flank (DE-A-686298, GB-A-112104), the concavity and the convexity being accentuated to the point that the tooth assumes a curved shape.

The machines comprising rotors of this type are characterized by their excellent performance in terms of volumetric efficiency and final pressure obtained.

A drawback of this type of rotor is that their manufacture by machining is rendered delicate owing to the presence of a peculiarity in the form of an acute angle which is situated at tooth crest of the concave flank.

The performance of machines implementing rotors with asymmetrical profiles is strongly linked, on the one hand, to the fineness with which the aforementioned geometric peculiarity is machined, and, on the other hand, to the manner in which the rotors are assembled and adjusted with a view to obtaining a predetermined operational play.

Machines implementing rotors with asymmetrical profiles and variable pitch (WO-A-02/08609) make it possible moreover to obtain very good performance, but the tolerances with respect to manufacture and assembly are very constraining.

One will easily see that it is not possible to guarantee that the sharp edge situated at the crest of the concave flank is uniformly machined along the edge, so much so that in practice a sharp edge situated at the crest of the concave flank thus exhibits deficiencies in regularity.

These deficiencies in machining translate into irregularities in the operational play present between two concave flanks when they co-operate along the screw, and leaks will impair the performance of the machine.

In addition, the edge at the crest of the concave flank is very susceptible to abrasion and the fluid which transits through the machine can lead to a wear and tear through abrasion which quickly worsens the performance of the machine.

Precisely, the invention concerns the rotary displacement machines the rotors of which are referred to as being of asymmetrical profile, and one result which the invention aims to obtain is a machine that, while being of less constrained manufacture, does not have as much reduced performance.

Another result which the invention aims to obtain is a machine the performance of which is maintained over time.

To this end, the invention has as its subject matter a machine of the aforementioned type.

BRIEF DESCRIPTION OF THE DRAWINGS

The invention will be better understood from reading the following description, given by way of non-limiting example, with reference to the attached drawings.

DETAILED DESCRIPTION OF EMBODIMENTS

Figure 1:
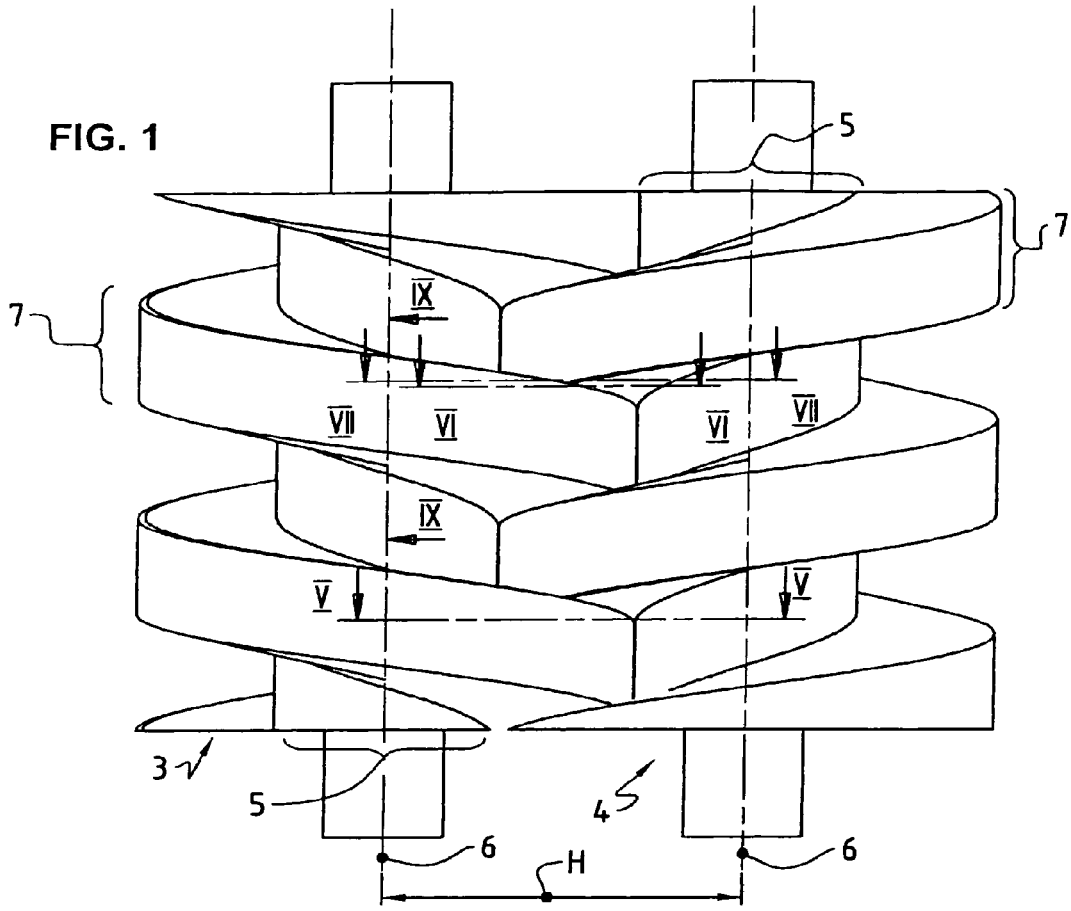
FIG. 1 illustrates a top view of two twinned rotors, each with a thread of constant pitch.
Figure 2:
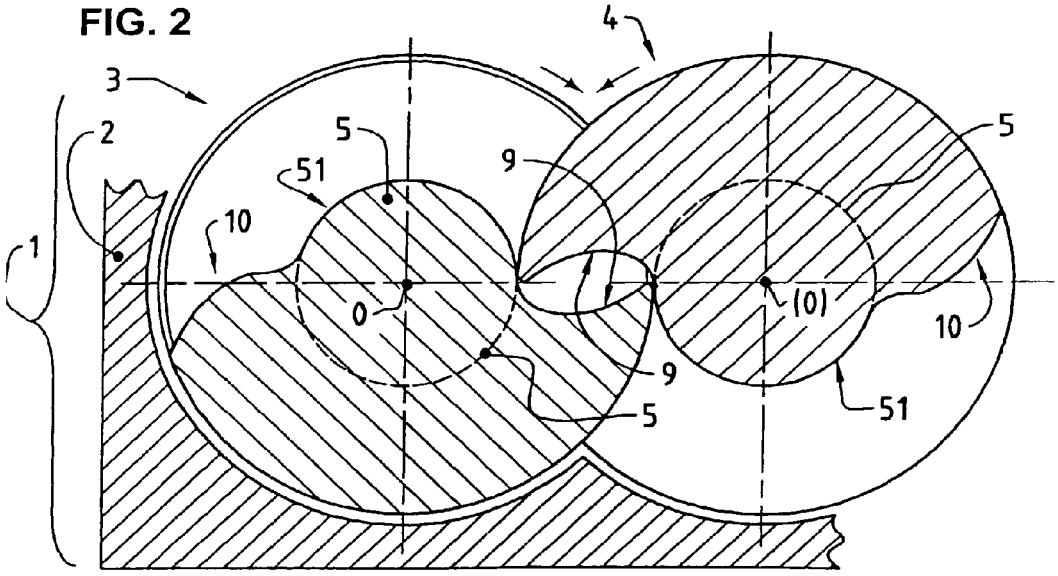
FIG. 2 illustrates a sectional view of the set of twinned rotors of FIG. 1, along a radial plane relative to the two rotors.

Referring to FIGS. 1 and 2, one sees a rotary displacement machine 1 including a housing 2 and at least two twinned rotors 3, 4 referred to as of asymmetrical profile, a first rotor 3 and a second rotor 4, said twinned rotors 3, 4, of which being mounted rotating in the housing 2 and driven in rotation about their longitudinal axis 6. FIGS. 9-13 illustrate various details and views of the rotary displacement machine embodied in FIGS. 1 and 2.

In a preferred, but non-limiting, way, the longitudinal axes 6 of the twinned rotors 3, 4 are parallel.

Figure 3:
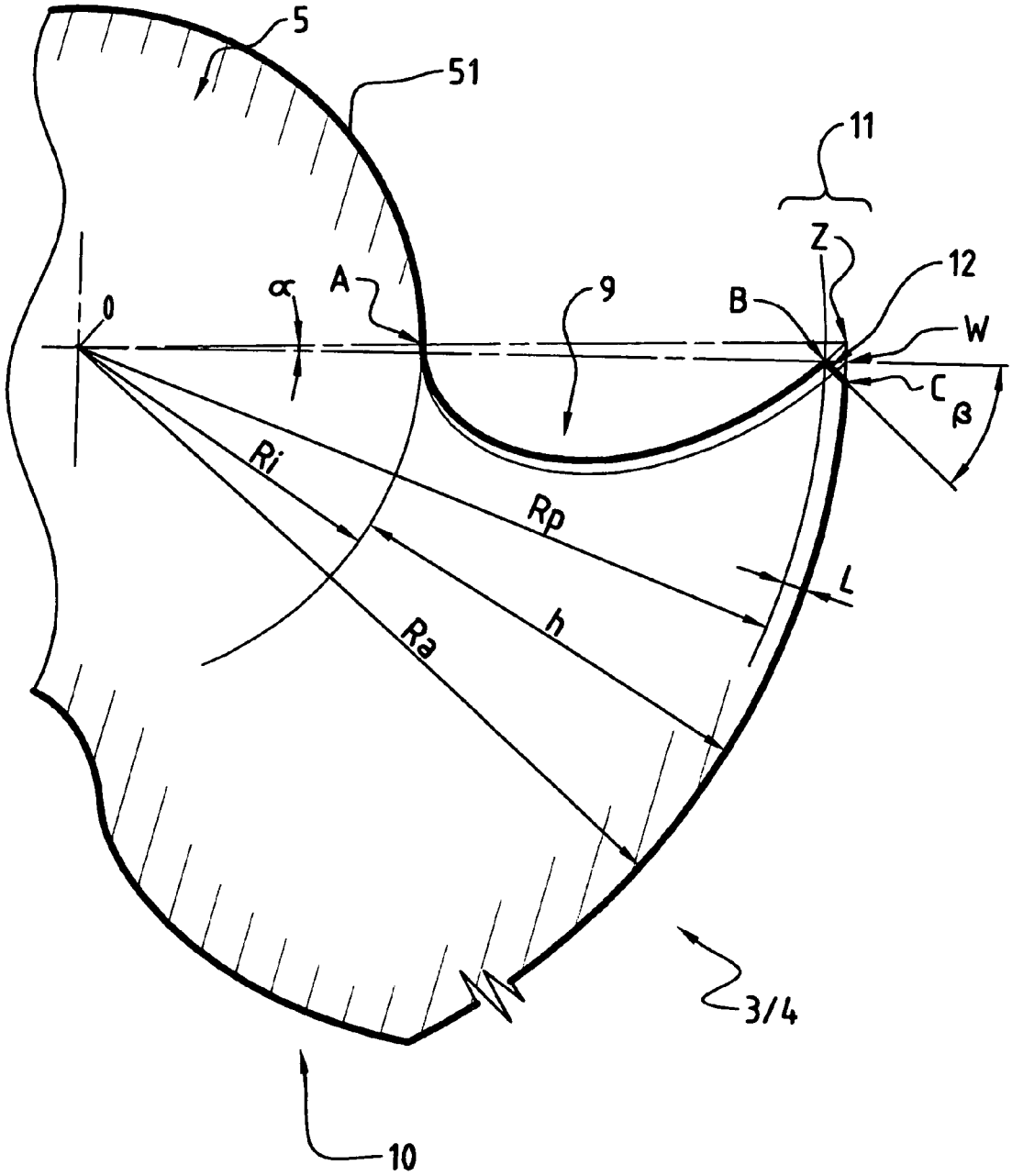
FIG. 3 illustrates on an enlarged scale, any one of the twinned rotors of FIG. 1, seen in section along a radial plane.
Figure 4:
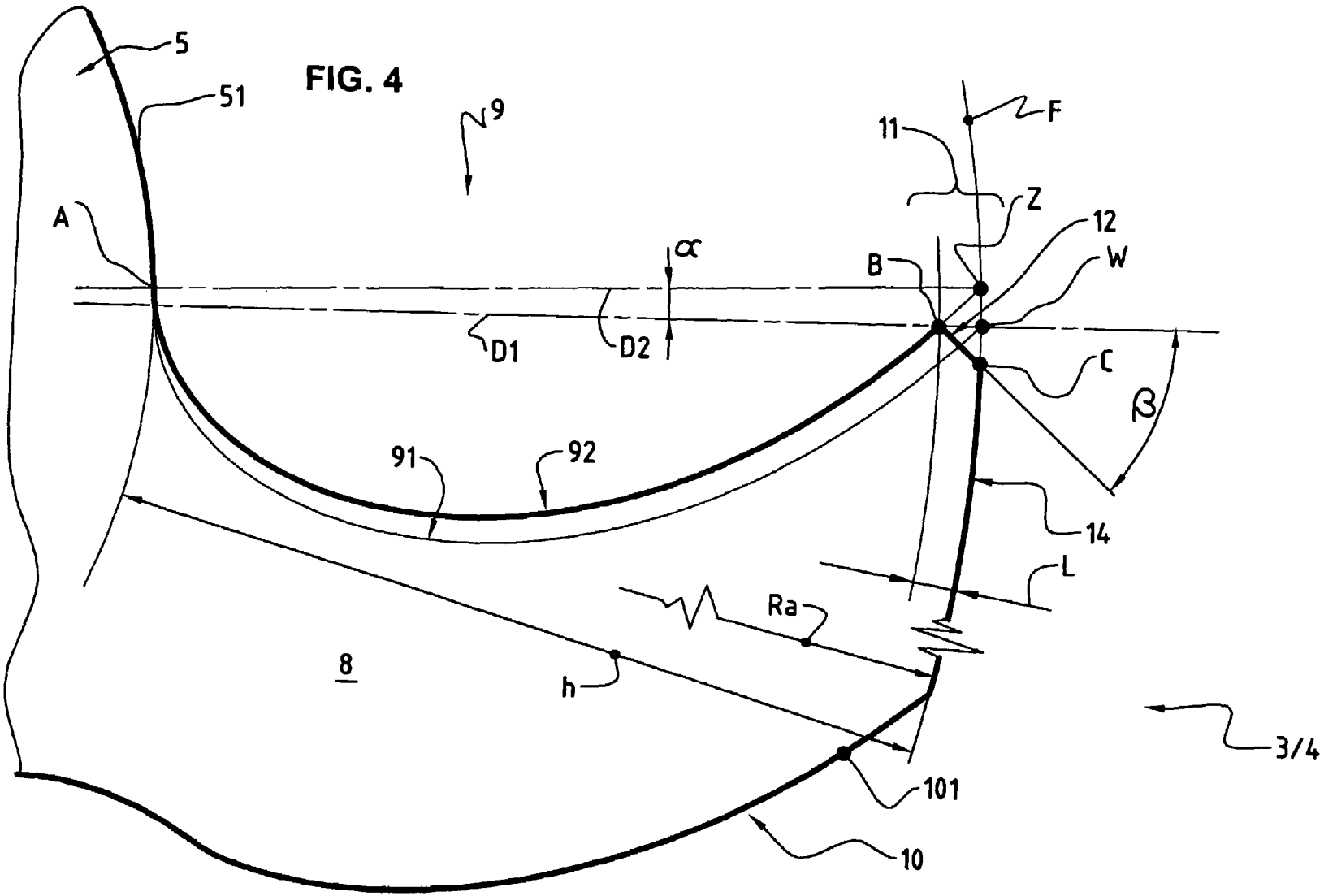
FIG. 4 illustrates on an enlarged scale, a detail from FIG. 3.

The twinned rotors 3, 4 are each made up of a core 5 on which projects at least one helicoidal thread 7 which, seen in a cross-sectional view (FIGS. 3 and 4) of that of the twinned rotors under consideration 3, 4, extends above said core 5 in the manner of a tooth 8, which tooth 8 has a first predetermined dimension "h" in a direction radial to the longitudinal axis 6 of that of the twinned rotors 3, 4 under consideration and above the surface 51 of this rotor, includes a first flank 9 of concave shape and a second flank 10 of convex shape which connect at the level of an upper portion 11 of the tooth 8, said first flank 9 having the shape of an epicycloidal arc (FIGS. 3 and 4).

The twinned rotors 3, 4 can be of constant pitch type or of variable pitch type.

Figure 5:
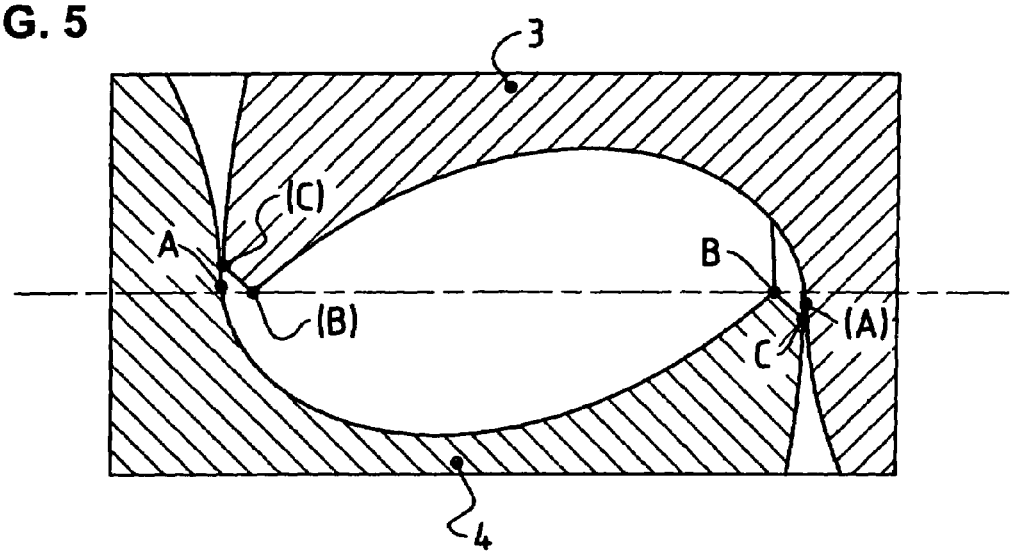
FIG. 5 illustrates a section of the meshing of the rotors of FIG. 1 in the plane V-V indicated in said FIG. 1.
Figure 6:
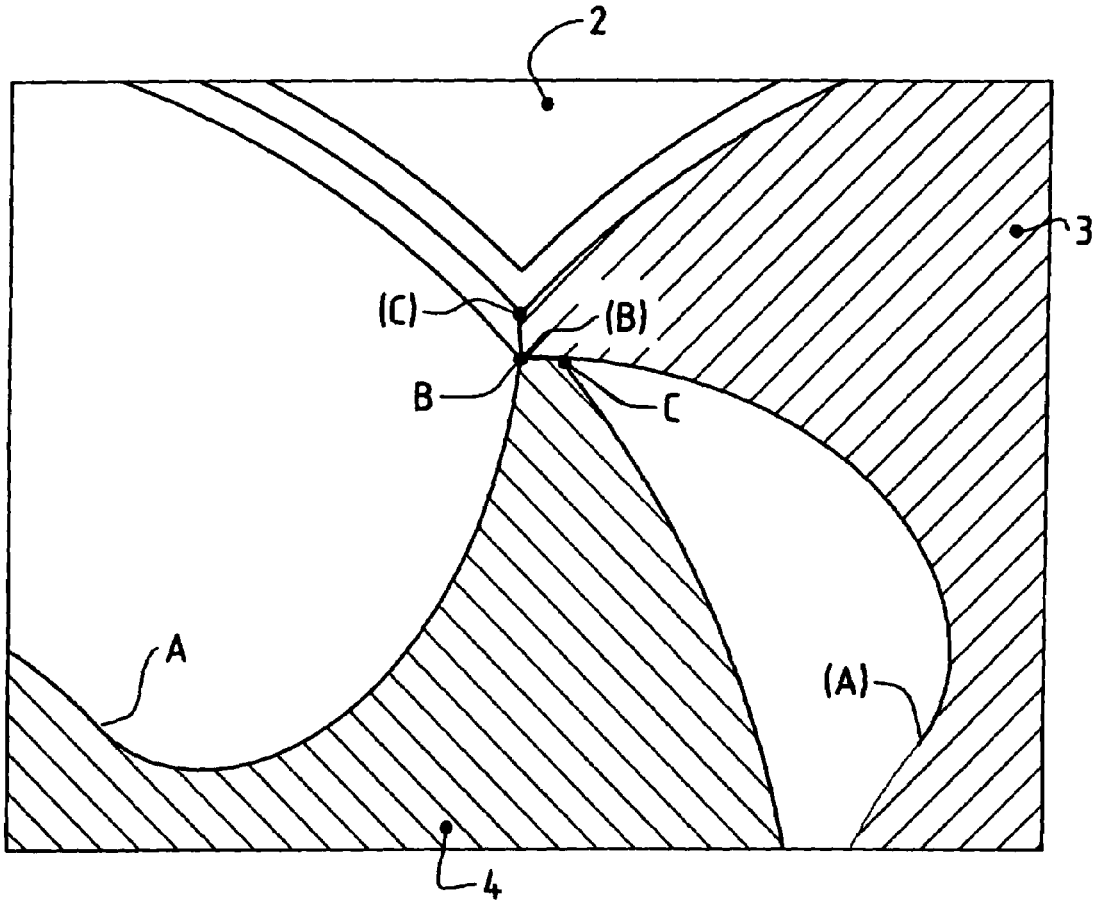
FIG. 6 illustrates a section of the meshing of the rotors of FIG. 1 in the plane VI-VI indicated in said FIG. 1.

In a noteworthy way, instead of including a first flank 9 and a second flank 10, the conventional shapes 91 and 101 connect at a first point "W" in such a way as to form a sharp edge along the helicoidal thread 7. On the one hand, said first flank 9 has a modified shape 92, of which the position and the length of the arc are predetermined in such a way that said modified shape 92 of this first flank 9 and the conventional shape 101 of the second flank 10 each connect to one of the opposite ends "B" and "C" of a short segment, referred to as connecting segment 12, which, by its presence along the entire helicoidal thread constitutes a helicoidal surface 13, referred to as flattened, eliminating the presence of a sharp edge (FIGS. 5 and 6). On the other hand, said connecting segment 12 has, in a direction radial to the longitudinal axis 6 of that of the twinned rotors 3, 4 under consideration, a second predetermined dimension "L", such that the ratio of the second dimension "L" over the first dimension "h" ranges between 0.005 and 0.1 (five thousandths and one tenth).

When each tooth of the twinned rotors 3, 4 is defined by a first flank 9 and a second flank 10 which are connected to an outer surface 14 of substantially cylindrical profile of outer radius "Ra", instead of this outer surface 14 being connected to the shape of the first flank 9 at a first point "W" in such a way as to form a sharp edge along the helicoidal thread 7, the outer surface 14 is connected to the shape of said first flank 9 by the connecting segment 12.

Preferably, the ratio of the second dimension "L" over the first dimension "h" ranges between 0.005 and 0.1 (five thousandths and one tenth), when the twinned rotors 3, 4 have a diameter ranging between fifty millimeters (50 mm) and three hundred fifty millimeters (350 mm).

In a likewise noteworthy way the conventional shape 91 of the first flank 9 and the circle, referred to as addendum circle "F" which circumscribes that of the twinned rotors 3, 4 being considered, have a point of intersection "W", referred to as first point "W", situated on a straight line "D1" which passes through a second point "O" situated on the longitudinal axis 6 of that of the twinned rotors 3, 4 being considered. The modified shape 92 of the first flank 9 and the circle "F" have a point of intersection "Z", referred to as third point "Z", situated on a second straight line "D2" which passes through the second point "O" and forms with the first straight line "D1" a first angle alpha (FIGS. 3, 4, 11, 13), the value of which is able to be approximated by calculation according to the first equation:

$$\mathrm{ArcCos}\left[\frac{-L^2(L-2Ra)^2+H^2(L^2-2LRa+2Ra^2)}{2H^2Ra(-L+Ra)}\right]$$

"Ra" representing the outer radius of that of the twinned rotors 3, 4 being considered, "L" representing the relative value of the connecting segment 12 in one direction radial to that of the twinned rotors being considered, the magnitude of the relative value corresponding to the difference between the outer radius "Ra" and the value of a radius "Rp" which separates the longitudinal axis 6 of the core 5 from a point of the connecting segment 12 which is closest to this longitudinal axis 6, and "H" representing the center distance of axes between the twinned rotors 3, 4.

The modified shape 92 of the first flank 9 and the outer surface 51 of the core 5 connect at a point "A".

In a manner also noteworthy, the connecting segment 12 is inclined with respect to the first straight line "D1" of a second angle beta whose value is able to be approximated by calculation according to the second equation:

Arc Cosine (H/(2 Ra))

with:

"H" representing the center distance of axes between the twinned rotors 3, 4, and "Ra" representing the outer radius of that of the twinned rotors 3, 4 being considered.

In practice, the position of the modified shape 92 of the first flank 9 can be adjusted by bringing about an oscillation of the support of the conventional shape 91 of said first flank 9, of a first angle Alfa about the point O.

The connecting segment 12 is inclined with respect to the first straight line "D1" of a second angle beta, this second angle being adjusted such that along the entire helicoidal threads 7 of the twinned rotors 3, 4, each helicoidal surface 13 which connects to a first flank 9 of one of the twinned rotors 3, 4 is able to extend substantially parallel at least to a zone of the first flank 9 of the other of the twinned rotors 3, 4 which is contiguous to the connecting segment 12 of this other rotor.

Figure 9:
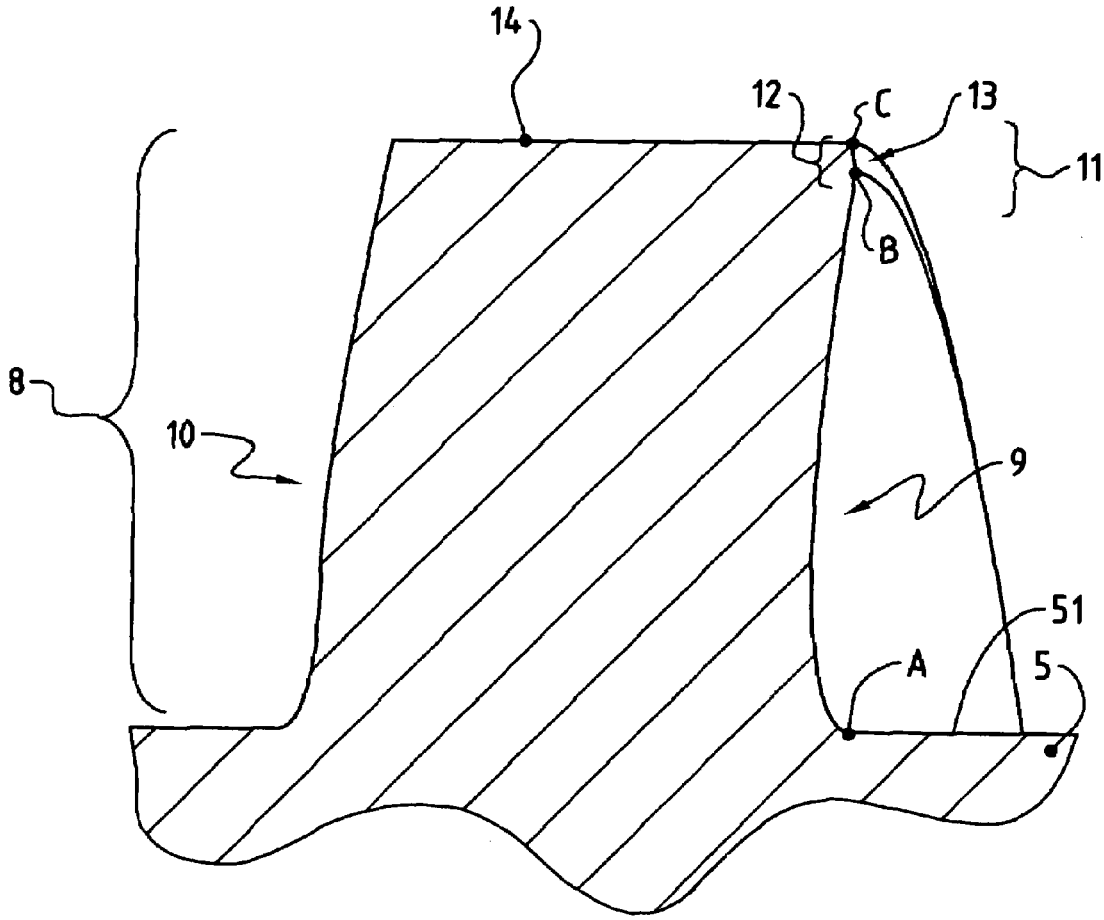
FIG. 9 illustrates on a large scale, a detail of one of the rotors of FIG. 1 in the plane IX-IX indicated in said FIG. 1.

A machine conforming to the present invention has instead and in place of the conventional sharp edge a helicoidal surface 13 made up of a flattened region (FIG. 9).

Such a flattened region can be machined easily and precisely, in particular by means of conventional tools, ensuring fewer leaks than with a sharp edge.

The variability of performance with respect to tolerances of machining and assembly will thus be clearly less, while providing a simplification of the machining of the twinned rotors and the possibility of increasing the operational play of the machine without reducing performance.

Advantageously, the helicoidal surface 13 obtained thanks to the presence of the flattened region remains a controlled surface, and this regardless of whether the pitch of the rotors is constant or variable.

Figure 7:
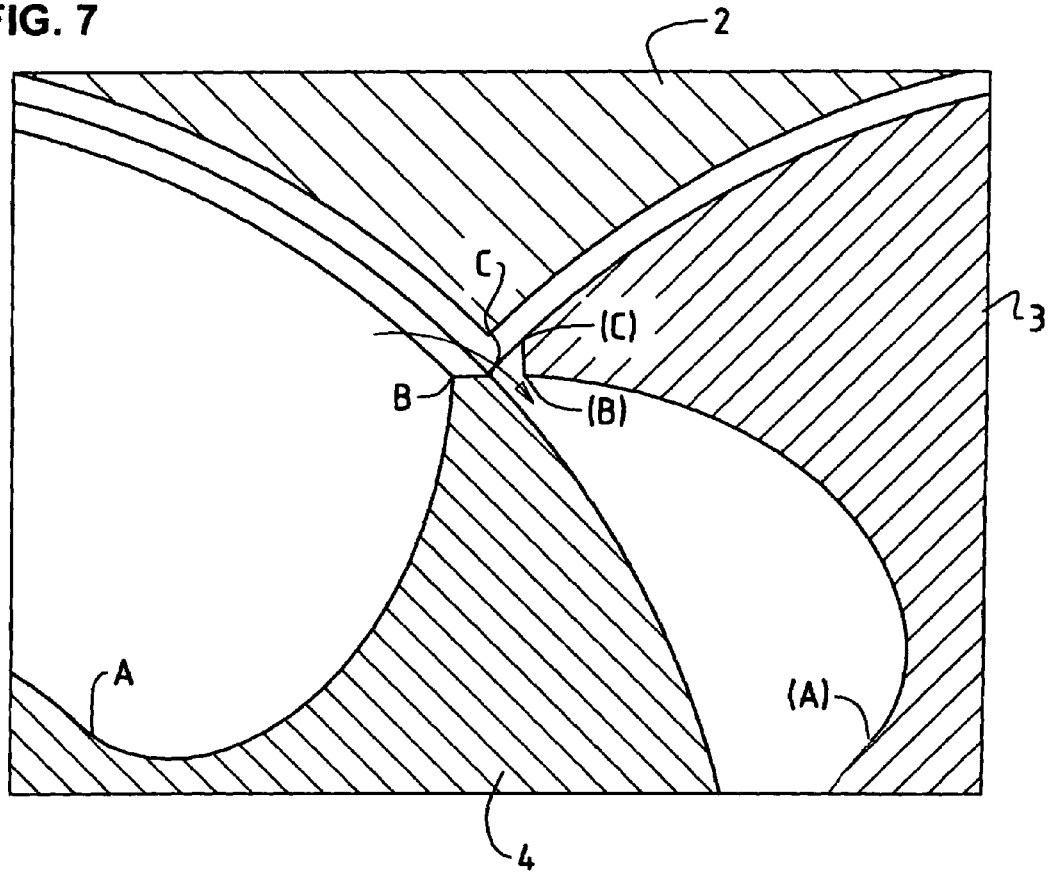
FIG. 7 illustrates a section of the meshing of the rotors of FIG. 1 in the plane VII-VII indicated in said FIG. 1.
Figure 8:
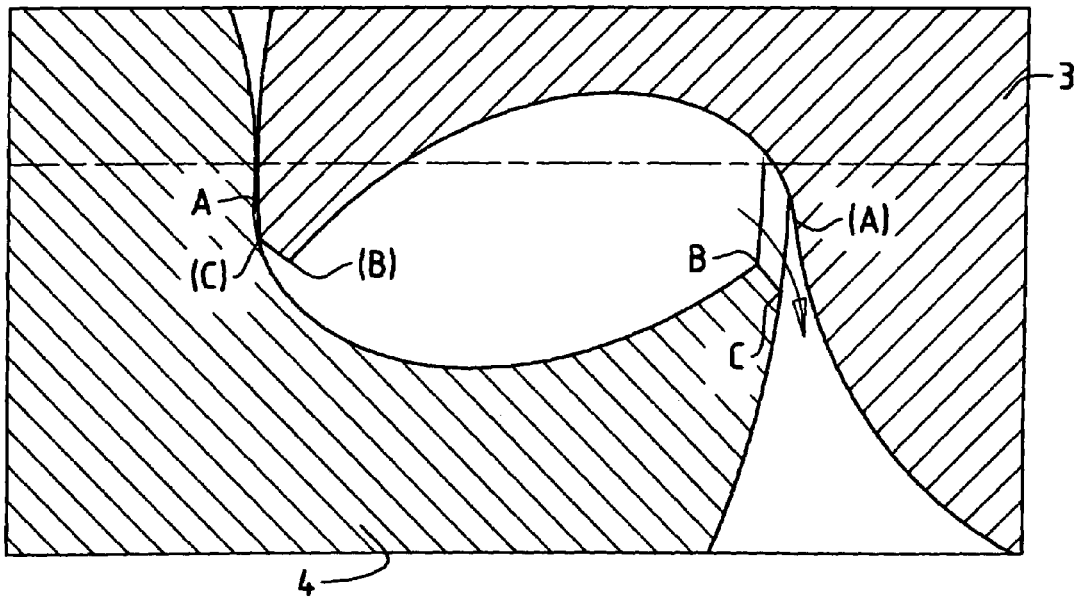
FIG. 8 illustrates a section of the meshing of the rotors of FIG. 1 in the plane slightly offset with respect to the plane V-V indicated in said FIG. 1.

As concerns the flattened region, it is also desirable for its length to remain small in relation to the tooth elevation in order to avoid the occurrence of a localized leak (expression better known by the German term "Blasloch" "blow hole") which is of a nature to reduce the performance of the system (FIGS. 7 and 8).

By way of illustrative example, for a radius "Ra" of 65 mm (sixty-five millimeters) and a tooth elevation "h" of 30 mm (thirty millimeters), a width "L" of flattened region 12 is 1 mm (one millimeter). For a radius "Ra" of 105 mm (one hundred and five millimeters) and a tooth elevation "h" of 60 mm (sixty millimeters), a width "L" of flattened region 12 is 1.5 mm (one point five millimeter), and for a radius "Ra" of 130 mm (one hundred thirty millimeters) and a tooth elevation "h" of 75 mm (seventy-five millimeters), a width "L" of flattened region 12 is 2 mm (two millimeters).

In the drawings, the localized leak has been symbolized by a simple arrow, not marked, in FIGS. 7 and 8.

FIG. 9 illustrates, on a large scale, a detail of one of the rotors of FIG. 1 in the plane IX-IX indicated in said FIG. 1.

Figure 10:
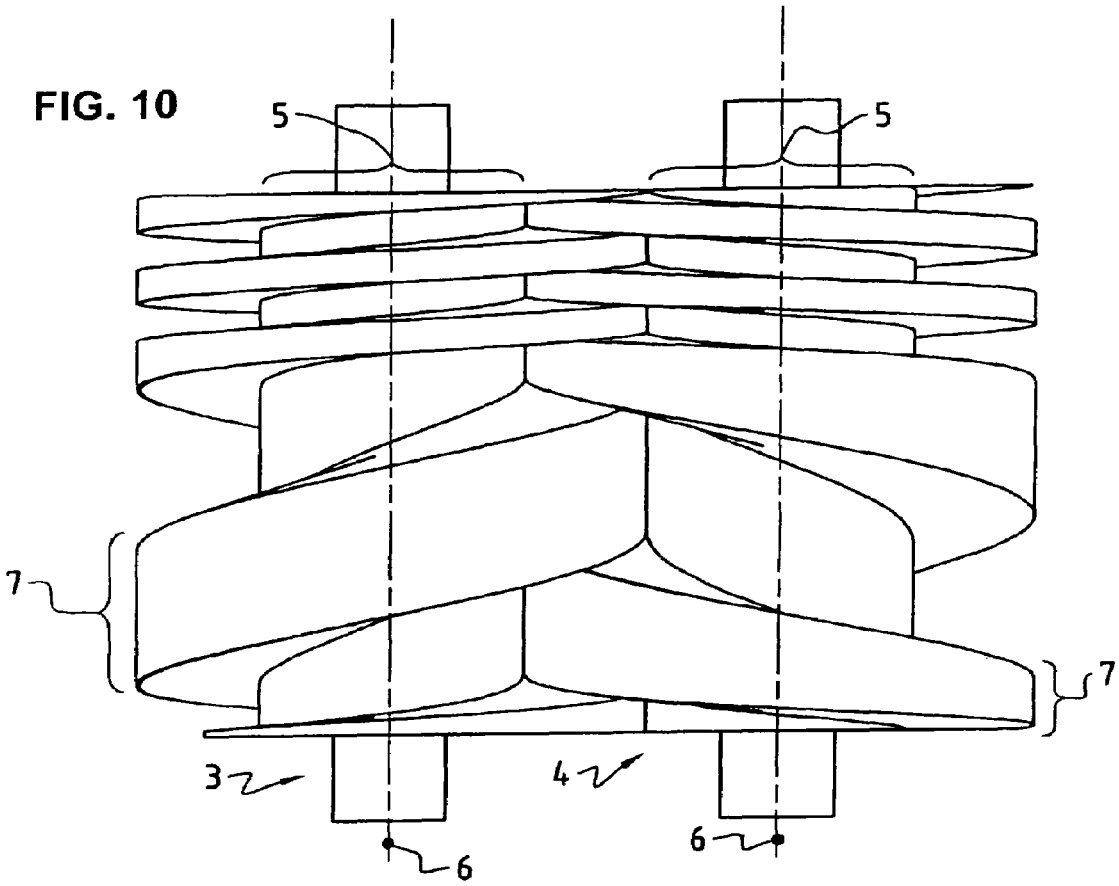
FIG. 10 illustrates in a top view, two twinned rotors, each with a variable pitch.

FIG. 10 illustrates in a top view, two twinned rotors, each with a variable pitch.

Figure 11:
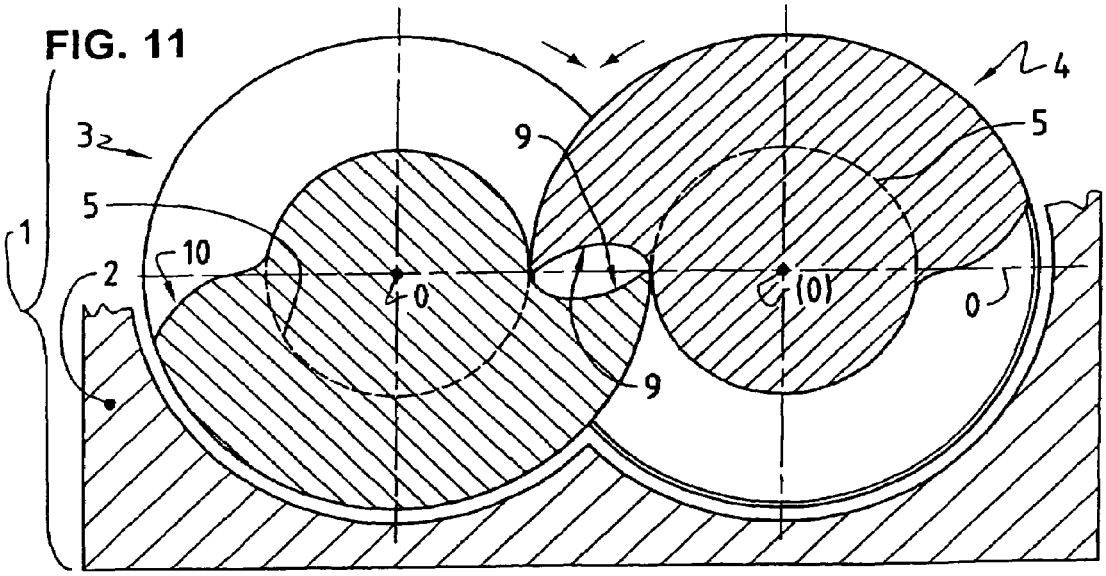
FIG. 11 illustrates a sectional view of the set of twinned rotors of FIG. 10, along a radial plane relative to the two rotors.

FIG. 11 illustrates a sectional view of the set of twinned rotors of FIG. 10, along a radial plane relative to the two rotors.

Figure 12:
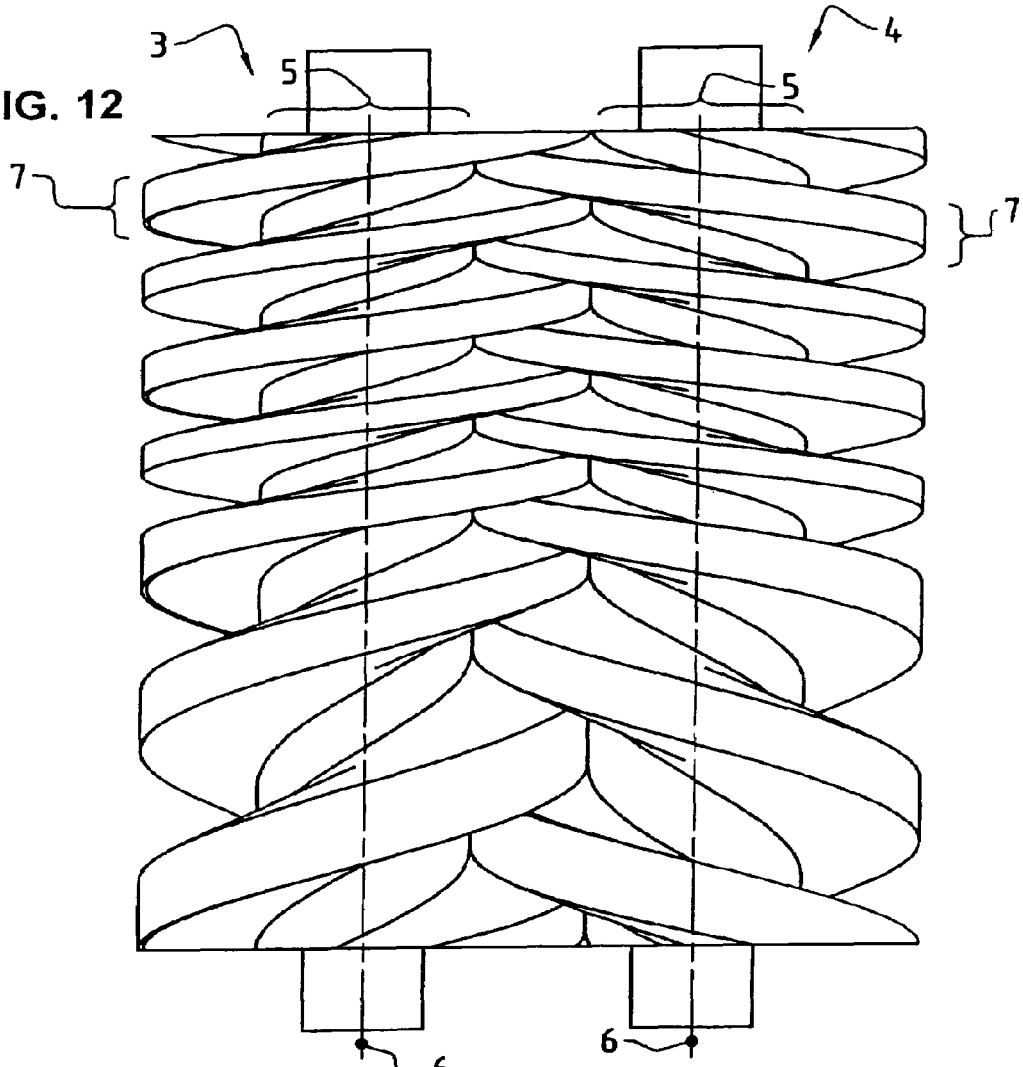
FIG. 12 illustrates in a sectional view, two twinned rotors, each with two threads of variable pitch.

FIG. 12 illustrates in a sectional view, two twinned rotors, each with two threads of variable pitch.

Figure 13:
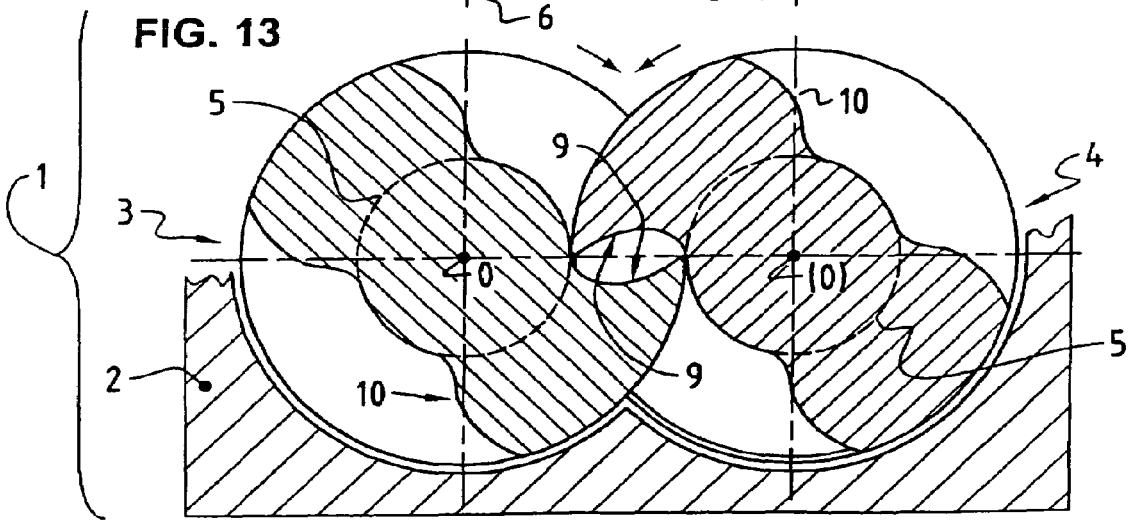
FIG. 13 illustrates a sectional view of the set of twinned rotors of FIG. 12, along a radial plane relative to the two rotors.

FIG. 13 illustrates a sectional view of the set of twinned rotors of FIG. 12, along a radial plane relative to the two rotors.

It must be noted that the above-mentioned dimensions, angles and profiles are defined to within the operational play.

It must likewise be noted that the mentioned characteristics are applicable to machines having more than two rotors.

The rotors being of the same diameter, of different diameter, even each having different diameters along their longitudinal dimension, remains compatible with the present invention.

The invention claimed is:

1. A rotary displacement machine comprising:

a housing; and at least two twinned rotors of asymmetrical profile, a first rotor and a second rotor being mounted to rotate in the housing about their longitudinal axis, the twinned rotors each comprising a core having at least one helicoidal thread which projects from the core and extends above the core in the manner of a tooth, the helicoidal thread having a first predetermined dimension in a direction radial to the longitudinal axis of the twinned rotors and above the surface of the rotors, wherein the helicoidal thread comprises a first flank of concave shape and a second flank of convex shape which connect at an upper portion of the helicoidal thread, the first flank having the shape of an epicycloidal arc, wherein the first flank has a shape whose position and length of arc are predetermined such that the first flank and the second flank each connect to one of the opposite ends of a connecting segment, which is presented along an entire length of the helicoidal thread and constitutes a flattened helicoidal surface thereby eliminating the presence of a sharp edge, wherein the connecting segment has, in a direction radial to the longitudinal axis of the twinned rotors, a second predetermined dimension, which is a radial component of the connecting segment, of length L such that the ratio of the second dimension over the first dimension ranges between 0.005 and 0.1.

2. The rotary displacement machine of claim 1, wherein each tooth of the twinned rotors is defined by the first flank and the second flank which are connected to an outer surface of a substantially cylindrical profile of an outer radius, wherein the outer surface is connected to the first flank by the connecting segment.

3. The rotary displacement machine of claim 1, wherein the ratio of the second dimension over the first dimension ranges between 0.005 and 0.1 when the twinned rotors have a diameter ranging between 50 mm and 350 mm.

4. The rotary displacement machine of claim 1, wherein the connecting segment is inclined with respect to a first straight line of a second angle β, the second angle being adjusted such that along the entire length of the helicoidal thread of the twinned rotors, each helicoidal surface which connects to the first flank of one of the twinned rotors extends substantially parallel at least to a zone of the first flank of the other of the twinned rotors which is contiguous to the connecting segment of the other of the twinned rotors.

5. The rotary displacement machine of claim 1, wherein the connecting segment is inclined with respect to a first straight line of a second angle β, the value of the second angle β being approximated by calculation according to a second equation:

$$\beta = \mathrm{ArcCos}\,(H/(2\,Ra)$$

where:

H represents the center distance of axes between the twinned rotors; and

Ra represents the outer radius of the twinned rotors.

6. The rotary displacement machine of claim 1, wherein the first flank and a circle which circumscribes the one of the twinned rotors have a point of intersection situated on a straight line which passes through a second point situated on the longitudinal axis of the twinned rotors, and the first flank and the circle have a point of intersection, situated on a second straight line which passes through the second point and forms with the first straight line a first angle α, the value of the first angle α being approximated by calculation according to a first equation:

$$\alpha = \mathrm{ArcCos}\left[\frac{-L^2(L-2Ra)^2 + H^2(L^2 - 2LRa + 2Ra^2)}{2H^2 Ra(-L+Ra)}\right] \text{ where:}$$

Ra represents the outer radius of the twinned rotors;

L represents a relative value of the connecting segment in one direction radial to the twinned rotors, a magnitude of the relative value corresponding to the difference between the outer radius Ra and the value of a radius which separates the longitudinal axis of the core from a point of the connecting segment which is closest to the longitudinal axis; and H represents the center distance of axes between the twinned rotors.

* * * * *